US009964299B2

(12) United States Patent
Vrdoljak

(10) Patent No.: US 9,964,299 B2
(45) Date of Patent: May 8, 2018

(54) STEAM GENERATOR

(75) Inventor: Ognjen Vrdoljak, Laval (CA)

(73) Assignee: SharkNinja Operating LLC, Needham, MA (US)

( * ) Notice: Subject to any disclaimer, the term of this patent is extended or adjusted under 35 U.S.C. 154(b) by 491 days.

(21) Appl. No.: 13/474,217

(22) Filed: May 17, 2012

(65) Prior Publication Data

US 2013/0058635 A1 Mar. 7, 2013

Related U.S. Application Data

(60) Provisional application No. 61/530,481, filed on Sep. 2, 2011.

(51) Int. Cl.

| | |
|---|---|
| ***A61H 33/06*** | (2006.01) |
| ***A47L 5/00*** | (2006.01) |
| ***D06F 75/00*** | (2006.01) |
| ***F22B 1/28*** | (2006.01) |
| ***F22B 37/00*** | (2006.01) |

(52) U.S. Cl.

CPC ..... *F22B 1/284* (2013.01); *F22B 37/00* (2013.01)

(58) Field of Classification Search

CPC ..... F22B 1/284

USPC ..... 392/394, 303, 308, 314, 316, 322, 324, 392/341, 342, 398, 445, 452, 455, 465, 392/473, 476, 484, 386, 396, 397, 399, 392/403–406; 15/401, 320; 38/77.1–77.9, 69, 74, 75

See application file for complete search history.

(56) References Cited

U.S. PATENT DOCUMENTS

| | | | | |
|---|---|---|---|---|
| 3,268,080 | A * | 8/1966 | Eberly, Jr. | 210/180 |
| 4,833,298 | A * | 5/1989 | Wilkins | 392/399 |
| 5,062,145 | A * | 10/1991 | Zwaan et al. | 392/396 |

(Continued)

FOREIGN PATENT DOCUMENTS

| | | |
|---|---|---|
| CN | 1714775 A | 1/2006 |
| CN | 1829837 A | 9/2006 |

(Continued)

OTHER PUBLICATIONS

EP2267209A1_translation.pdf.*

(Continued)

*Primary Examiner* — Dana Ross
*Assistant Examiner* — Ket D Dang
(74) *Attorney, Agent, or Firm* — Grossman Tucker Perreault & Pfleger, PLLC

(57) ABSTRACT

A steam generator includes an inlet configured to receive a liquid (such as water); a heating element for converting the liquid into a vapor (such as steam), the vapor bearing particles such as mineral deposits formed by the converting of the liquid; an outlet in fluid communication with the inlet, the outlet configured to discharge filtered vapor and having a size on the order of larger ones of the particles; and a filter structure adjacent to the outlet to filter the larger particles out of the vapor to produce the filtered vapor for discharge from the outlet. By action of the filter structure, larger particles are prevented from reaching the outlet, reducing clogging and extending the usable lifetime of a small appliance containing the steam generator. The filter structure may include spaced-apart members such as posts or pillars extending perpendicularly in a planar fluid flow passage.

12 Claims, 7 Drawing Sheets

(56) References Cited

U.S. PATENT DOCUMENTS

| | | | | |
|---|---|---|---|---|
| 5,864,596 | A * | 1/1999 | Egerbrecht et al. | 376/306 |
| 7,801,424 | B2 * | 9/2010 | Cheung | A61H 33/063 392/385 |
| 8,811,807 | B2 * | 8/2014 | Blanc et al. | 392/467 |
| 8,821,640 | B2 * | 9/2014 | Cleary et al. | 118/726 |
| 2001/0000830 | A1 * | 5/2001 | Kasper | A47L 5/30 15/320 |
| 2005/0072382 | A1 * | 4/2005 | Tippmann, Sr. | 122/460 |
| 2007/0143914 | A1 * | 6/2007 | Shirai | E03D 9/08 4/420.2 |
| 2007/0240458 | A1 * | 10/2007 | Kim | D06F 39/008 68/5 R |
| 2008/0006063 | A1 * | 1/2008 | Ahn et al. | 68/5 R |
| 2008/0066789 | A1 | 3/2008 | Rosenzweig et al. | |
| 2009/0007603 | A1 * | 1/2009 | Chul | D06F 39/008 68/5 R |
| 2009/0106929 | A1 * | 4/2009 | Oh | A47L 11/34 15/321 |
| 2009/0211314 | A1 * | 8/2009 | Cho | D06F 39/008 68/5 C |
| 2009/0320231 | A1 | 12/2009 | Rosenzweig et al. | |
| 2010/0034526 | A1 * | 2/2010 | Kleemann | F22B 1/284 392/333 |
| 2010/0186463 | A1 * | 7/2010 | Vrdoljak et al. | 68/222 |
| 2011/0036308 | A1 | 2/2011 | Betzer-Zilevitch | |

FOREIGN PATENT DOCUMENTS

| | | | | |
|---|---|---|---|---|
| CN | 101191612 | A | 6/2008 | |
| CN | 201152517 | Y | 11/2008 | |
| CN | 101358727 | B | 9/2010 | |
| CN | 202132923 | U | 2/2012 | |
| CN | 202647693 | U | 1/2013 | |
| CN | 103453505 | B | 9/2015 | |
| EP | 0658647 | B1 | 7/1998 | |
| EP | 2267209 | A1 * | 12/2010 | D06F 39/008 |
| EP | 2146059 | B1 | 8/2013 | |
| GB | 1253893 | A | 11/1971 | |
| JP | H02-193680 | A | 7/1990 | |
| JP | 2000-516337 | A | 12/2000 | |
| JP | 2005-069632 | A | 3/2005 | |
| JP | 2006084059 | A | 3/2006 | |
| RU | 2047565 | C1 | 11/1995 | |
| RU | 73944 | U1 | 10/2008 | |
| SU | 1535595 | A1 | 1/1990 | |

OTHER PUBLICATIONS

International Searching Authority, International Search Report for International Application No. PCT/US2012/053364, dated Nov. 29, 2012, 3 pgs. (unnumbered).

International Searching Authority, Written Opinion for International Application No. PCT/US2012/053364, dated Nov. 29, 2012, 3 pgs. (unnumbered).

Office Action from Japanese Application No. 2014-528642 dated Jun. 8, 2015.

Supplementary European Search Report from European Application No. 12827088.1 dated Jul. 30, 2015.

Office Action from Canadian Application No. 2,847,409 dated Mar. 26, 2015.

Office Action from Chinese Application No. 201280050322.6 dated Mar. 13, 2015.

Office Action from Chinese Patent Application No. 201280050322.6 dated Oct. 19, 2015.

Office Action from Japanese Patent Application No. 2014-528642 dated Nov. 9, 2015.

Office Action from Canadian Application No. 2,847,409 dated Feb. 9, 2016.

Office Action from Japanese Application No. 2014-528642 dated May 31, 2016.

Office Action dated Nov. 24, 2016 in corresponding Australian Patent Application No. 2012301700.

* cited by examiner

STEAM GENERATOR

BACKGROUND

The present invention relates to the field of steam generators for small steam appliances such as steam cleaners, steam mops, etc.

It is known to employ steam generators to convert liquid water into steam as part of the operation of a small steam appliance such as a consumer steam cleaner, steam mop, etc. A steam generator typically includes a heating element and surrounding structure that establishes a fluid flow path along which the water flows to be converted into steam by heat from the heating element. The resulting steam is provided via an outlet of the steam generator to a separate steam discharge component of the small appliance.

SUMMARY

In a small steam appliance, steam may be discharged from a steam generator at a relatively narrow outlet from which it travels to a steam discharge component or other point of use in the appliance. During the conversion process, solid particles such as mineral salts may be formed due to the presence of minerals such as calcium and magnesium in the water. The salts are deposited within the steam generator and the deposits build up over time. Deposited material can be dislodged in the form of relatively large particles that can cause blockage at the outlet. In time, the blockage can increase to the point of reducing the effective operation of the appliance or rendering it completely unusable. Thus, the natural action of particle formation in a steam generator of an appliance may determine the length of the useful life of the appliance.

Disclosed is a steam generator capable of delivering good life expectancy by reducing such blockage at an outlet at which steam is discharged. The steam generator includes an inlet configured to receive a liquid (such as water); a heating element for converting the liquid into a vapor (such as steam), the vapor bearing particles formed by the converting of the liquid; an outlet in fluid communication with the inlet, the outlet configured to discharge filtered vapor and having a size on the order of larger ones of the particles; and a filter structure adjacent to the outlet to filter the larger particles out of the vapor to produce the filtered vapor for discharge from the outlet. By action of the filter structure, larger particles are prevented from reaching the outlet, reducing clogging and extending the usable lifetime of a small appliance containing the steam generator.

In some embodiments, the filter structure includes a set of spaced-apart members forming a screen substantially larger than an opening of the outlet. The members may be formed as posts or pillars extending perpendicularly in a planar passage through which the liquid and vapor flow. These posts or pillars may be integrally formed with a cover or other structural member of the steam generator, such as by molding or die casting. The spacings among the members may be set in relation to a diameter of the outlet to ensure that larger particles become trapped by the members while smaller particles can pass through the members and exit the outlet.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

It will be appreciated by those of ordinary skill in the art that the disclosure can be embodied in other specific forms without departing from the spirit or essential character thereof. The presently disclosed embodiments are therefore considered in all respects to be illustrative and not restrictive.

Figure 1:
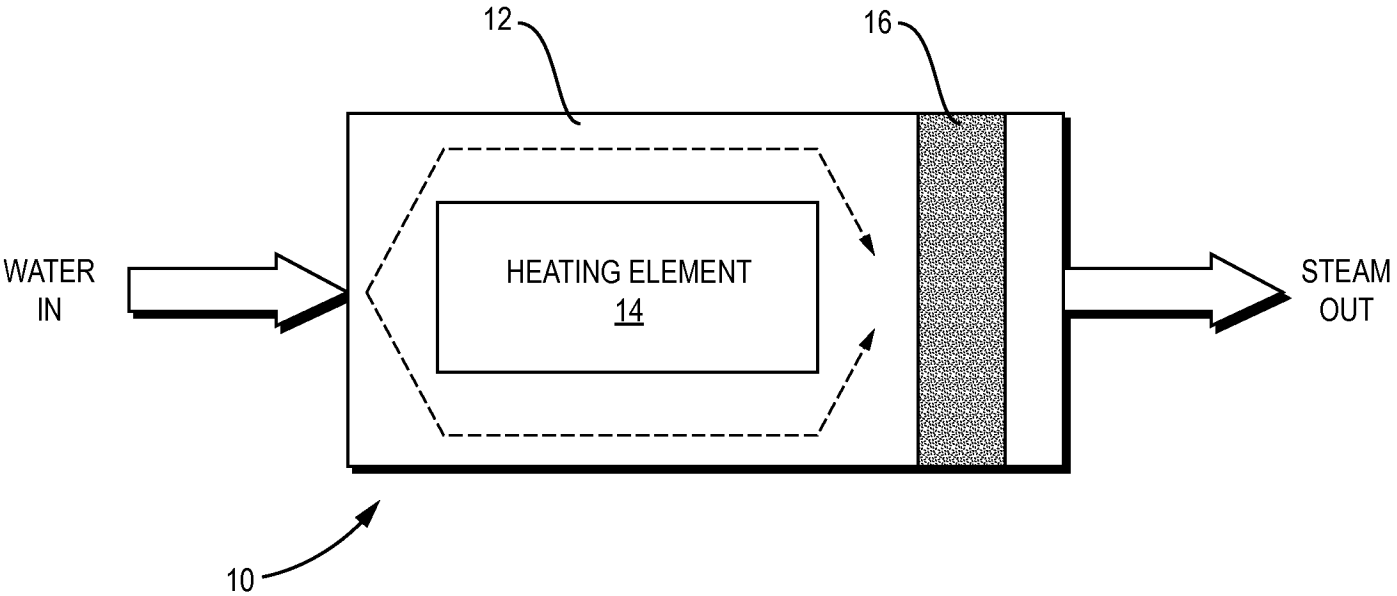
FIG. 1 is a schematic diagram of a steam generator.

FIG. 1 is a schematic diagram of a steam generator 10 of the type used in a small appliance. It generally includes a housing or other structure defining a chamber 12 in which liquid water from an inlet is heated by a heating element 14 to form steam that is discharged at an outlet. Adjacent to the outlet is a filter structure 16 that filters out particles greater than a certain size, preventing them from reaching the relatively narrow outlet where they would contribute to clogging and degrade operation of the appliance.

Generally, the filter structure 16 (also referred to as "filter" 16 herein) has an effective surface area across the flow path that is significantly larger than the opening of the outlet, so that the rate at which the filter 16 becomes clogged by filtered particles is much lower than the rate at which the outlet would become clogged in the absence of the filter. For example, the effective surface area of the filter may be five times the size of the outlet opening or greater. Specific examples are described below.

Although not shown in FIG. 1, it will be understood that the steam generator 10 receives water from a water feeding system, which may include a reservoir, piping or tubing, and one or more valves. Water may be fed under force of gravity, or some form of mechanical pressurization such as a pump may be employed. The steam is channeled to one or more points of use, which may be discharge nozzles/openings at an outer surface of the appliance for example.

Figure 2:
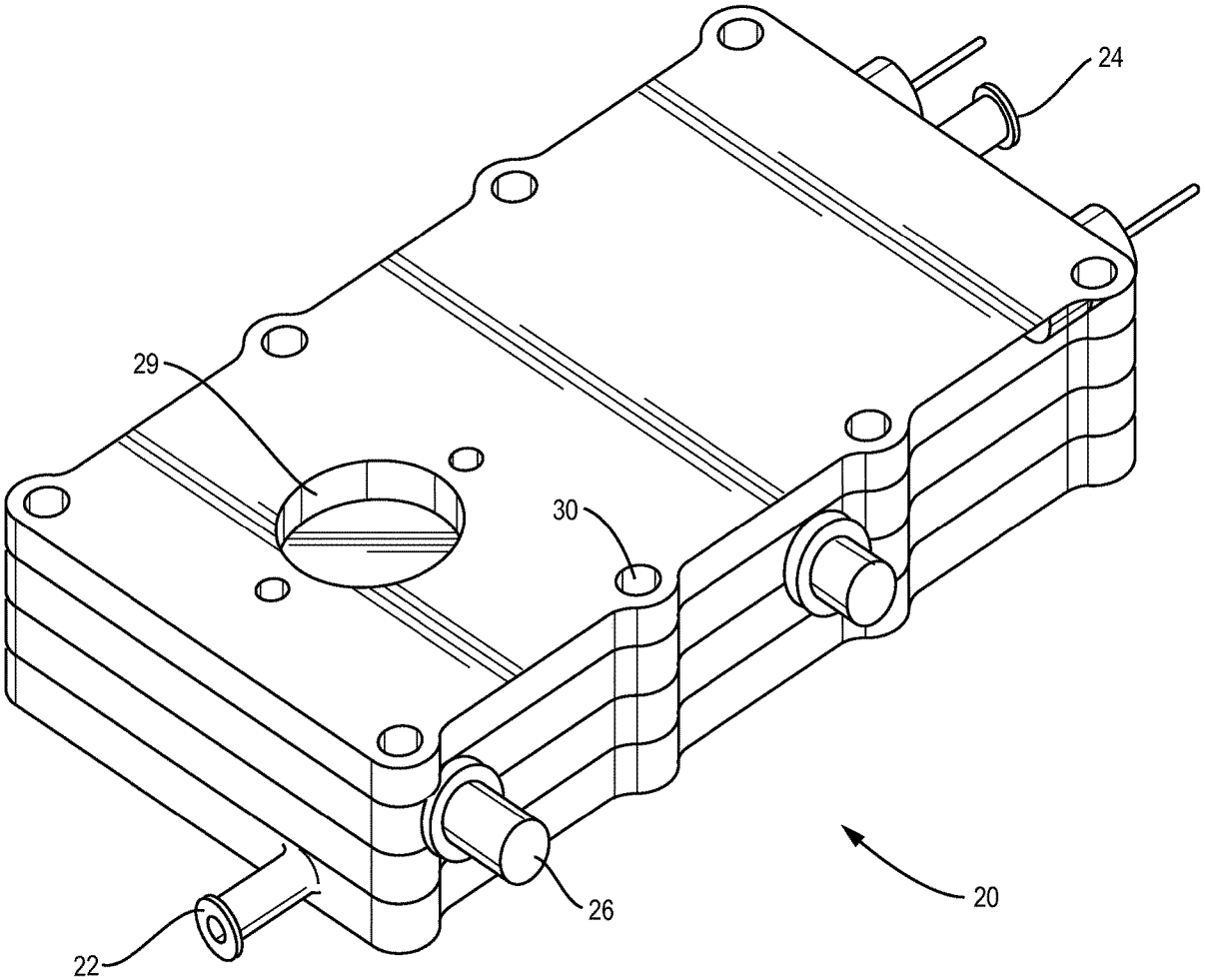
FIGS. 2 and 3 are perspective views of a steam generator.
Figure 3:
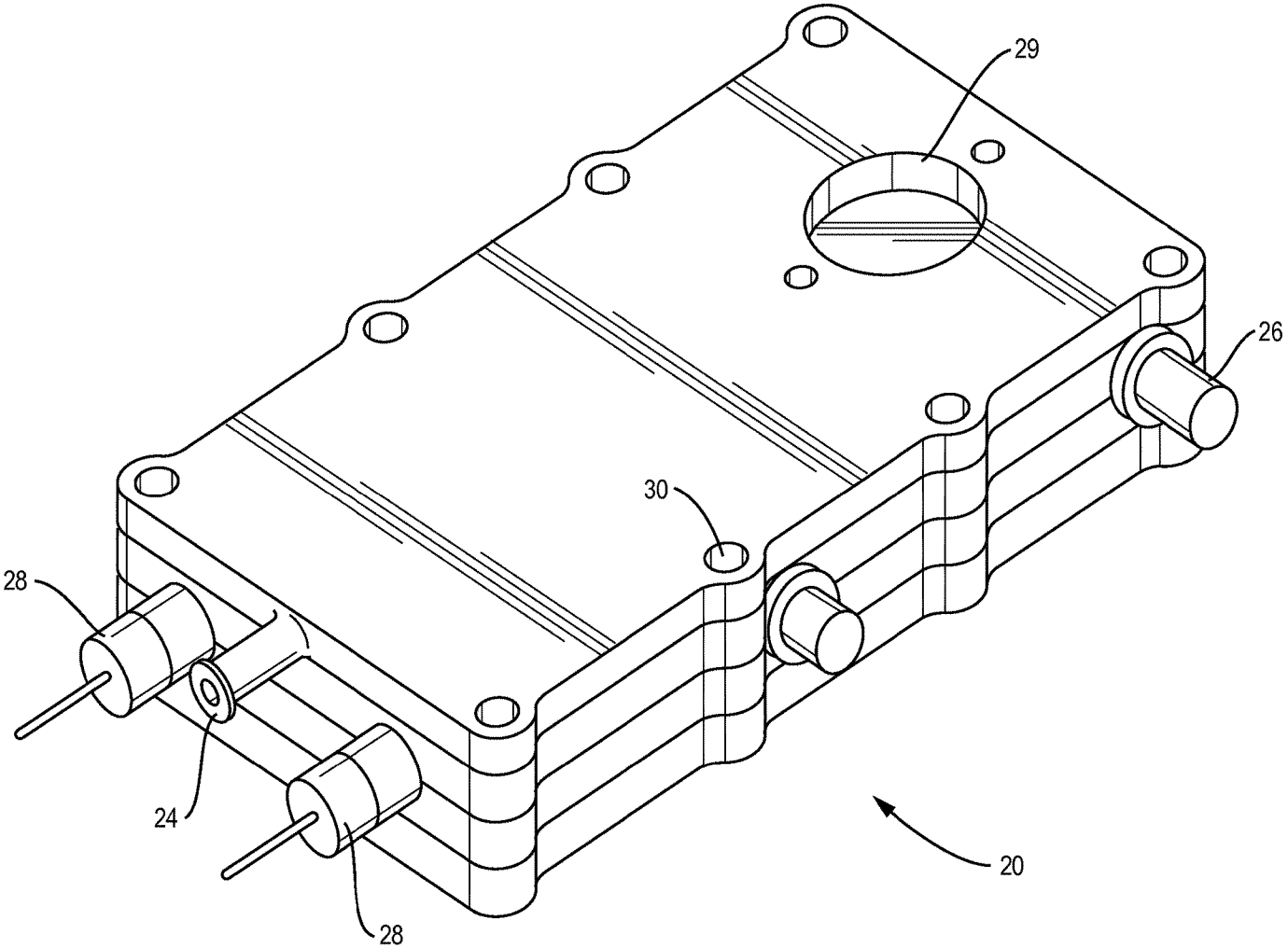

FIGS. 2 and 3 are perspective views of a steam generator 20 from respective ends according to one embodiment of the present disclosure, where the steam generator 20 implements the generalized arrangement shown in FIG. 1. In some instances, a steam generator 20 may also be referred to as a boiler. The steam generator 20 includes a body or a housing having an inlet 22 configured to receive a liquid. In some embodiments, the liquid may be water or a mixed solution, among other types of liquids or fluids. In other embodiments, the mixed solution may be a mixture of vinegar/water, detergent/water or cleaning solution/water, among other suitable cleaning mixtures.

The steam generator 20 includes an internal heating element (not shown in FIGS. 2 and 3) receiving electrical power via a pair of electrical contacts 28. The heating element is capable of converting the liquid into a vapor (e.g., convert water into steam). The steam generator 20 also includes an outlet 24 in fluid communication with the inlet 22, where the outlet 24 is capable of discharging the vapor produced within the steam generator 20. For example, water converted into steam by the heating element can exit (e.g., be expelled or discharged from) the outlet 24.

As shown in FIGS. 2 and 3, parts of the housing or body of the steam generator 20 may include posts 26 or similar external mechanical features which are used for mounting the steam generator 20 within a steam appliance such as a steam mop or a handheld steamer, among other steam-using devices. Examples of steam appliances include those disclosed in U.S. Patent Publications US2009/0320231A1 and US2008/0066789A1, each of which is incorporated herein by reference in its entirety for all purposes.

Also shown in FIGS. 2 and 3 are a plurality of apertures 30. As described in more detail below, the steam generator 20 is constructed of multiple planar sections, and the apertures 30 receive bolts (not shown) used to fasten sections together. In other embodiments, a steam generator may be molded or employ some other means of joining sections, so that the apertures 30 are not necessary. In some embodiments, the steam generator 20 can be modularly constructed, among other suitable fabrication methods.

Also shown in FIGS. 2 and 3 is a hollow or hole 29 used to hold a separate thermostat (not shown). The thermostat provides an electrical output indicative of the temperature of the steam generator 20, the output being used by separate control circuitry (also not shown) to switch or otherwise control the electrical power provided to the steam generator 20 so as to maintain temperature within a desired range during operation. In one embodiment, steam discharged from the outlet 24 has a temperature of about 120 C, which is achieved by maintaining a temperature at the thermostat of about 140 C. In the illustrated embodiment the hollow 29 for the thermostat is located adjacent to the inlet 22, which may be desirable for more responsive temperature sensing and control during operation.

Figure 4:
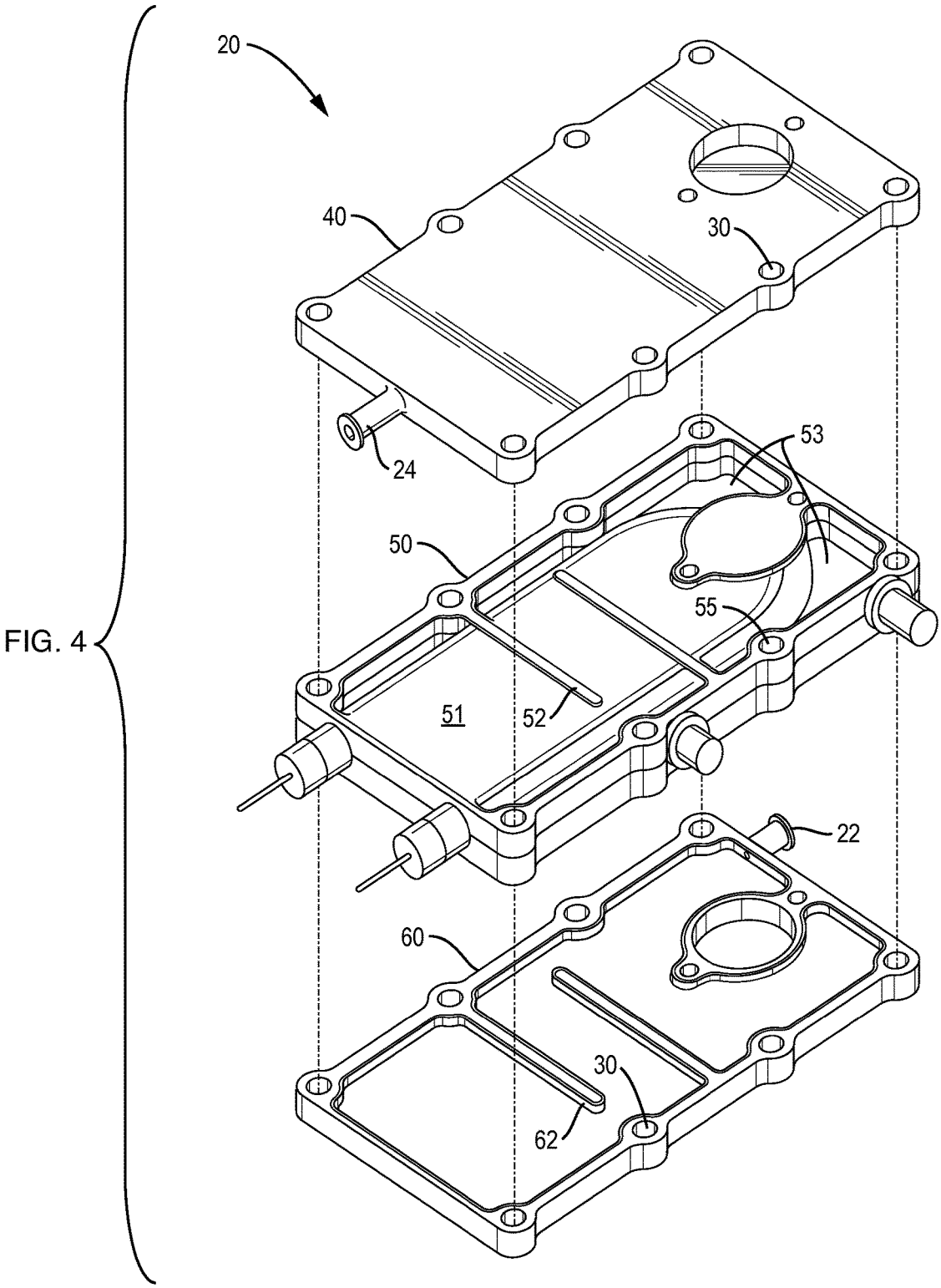
FIG. 4 is a deconstructed or exploded view of the steam generator.

FIG. 4 is an exploded view of the steam generator 20 showing three separate sections or portions referred to as a top 40, center section 50, and bottom 60. The heating element is located in the center section 50 within a two-sided planar casing 51 (further details provided below), surrounded by the top 40 and bottom 60 as outer members or covers of the assembly. Respective sets of vanes (items 52 and 62 for center section 50 and bottom 60 respectively, not visible for top 40 in FIG. 4), define short serpentine flow paths along which water and vapor flow from the inlet 22 to the outlet 24. Additionally, water and vapor flow from the bottom side of the casing 51 to the top side via open areas 53 between a peripheral edge of the casing 51 and the peripheral wall of the center section 50. During operation, water traveling the internal flow path from the inlet 22 is in intimate contact with the casing 51 and is heated beyond its boiling point to create steam which is discharged via the outlet 24.

Further regarding the vanes 52, 62, they define points at which a direction of the fluid flow path changes abruptly (e.g., at openings in their ends). While serpentine paths are useful to increase heat transfer to the fluid, they can contribute to the build-up of deposits if their lengths are excessive. Thus, it is generally preferred that there be only a small number of direction changes in the fluid flow paths, such as three or less. In the illustrated embodiment, there are only two such changes of direction of the path across a surface of the center section 50.

As previously mentioned, the sections 40, 50 and 60 may be bolted together in one embodiment. To that end, the center section 50 may have threaded openings 55 on both its top and bottom faces, while the top 40 and bottom 60 have unthreaded openings 30 through which respective bolts (not shown) extend to engage the threaded openings 55 and thereby hold the top 40 and bottom 60 to the center section 50. It will be appreciated by one skilled in the art that although the steam generator 20 as disclosed herein has three sections 40, 50 and 60, the steam generator 20 can be fabricated using fewer or more sections as may be desirable in alternative embodiments.

Figure 5:
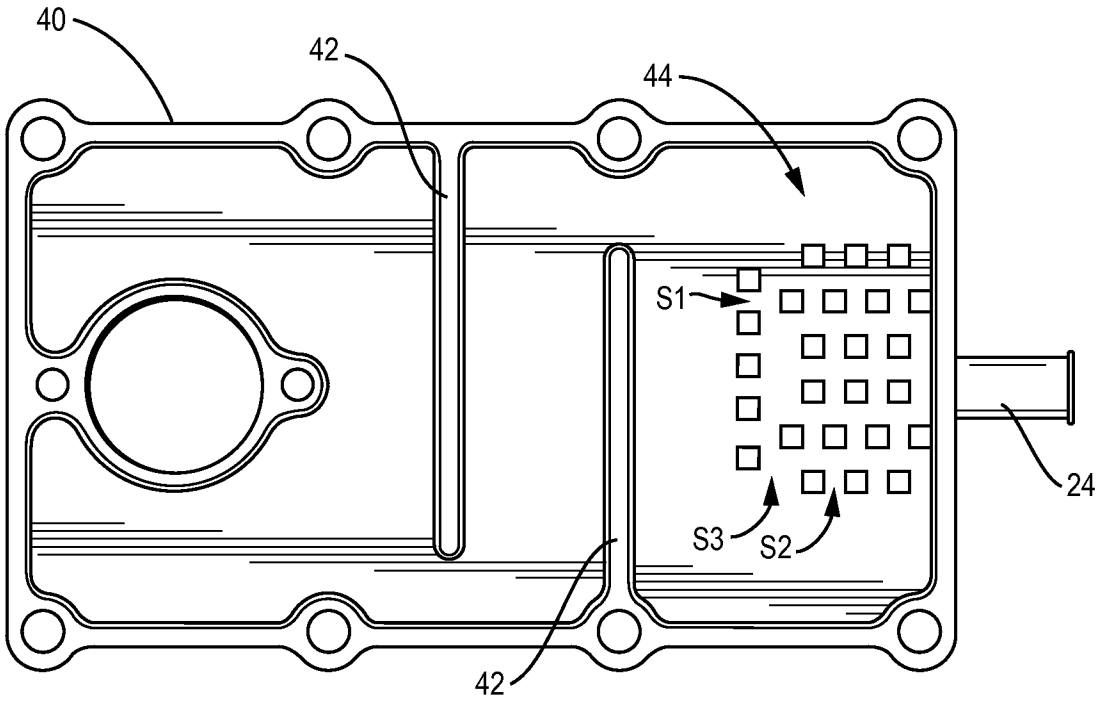
FIG. 5 is a view of an inner surface of a top of the steam generator.

FIG. 5 is a plan view of the inner surface of the top 40 of the steam generator 20, which faces the top surface of the center section 50 when assembled together. As shown, the top 40 includes the outlet 24 where the vapor is discharged. In one embodiment, the diameter of an inner bore of the outlet 24 can be in the range of about 1 mm to about 10 mm. The term "about" herein signifies deviation of no more than +/−20%. The diameter of the outlet 24 can be any of a variety of values in different embodiments, including for example about 1.5 mm, or about 2 mm, or about 2.5 mm, or about 3 mm, or about 3.5 mm, or about 4 mm, or about 4.5 mm, or about 5 mm, or about 6 mm, or about 7 mm, or about 8 mm, or about 9 mm. In other embodiments, the diameter of the outlet 24 can be less than about 10 mm, or less than about 7.5 mm, or less than about 5 mm, or less than about 2.5 mm.

The top 40 includes a pair of vanes 42 that engage the top-surface vanes 52 of the center section 50 (FIG. 4) for guiding the liquid and vapor as described above. In operation, the liquid and vapor travelling within planar cavities or passages between the top 40 and the center section 50 are guided or directed by the vanes 42, 52. In some embodiments, the liquid and/or vapor may be influenced or perturbed by the vanes 42, 52 to produce desired agitation, which is discussed more below.

The top 40 includes a plurality of spaced-apart members 44 disposed substantially adjacent to the outlet 24. These function as the filter structure 16 of FIG. 1. The members 44 may be formed as pins, posts or pillars extending from the inner surface of the top 40 and/or from the facing surface of the center section 50. In the illustrated embodiment, the members 44 extend vertically across a planar passage at the outlet 24, either partially or entirely between respective surfaces of the top 40 and center section 50 when assembled together.

Liquids such as water from residential or commercial water supplies may contain dissolved minerals or other matter than can form deposits on the inner surfaces of the steam generator 20 from the heating of the liquid to vapor (e.g., water to steam). Typical minerals contained in water include calcium and magnesium, among other elements, compounds and minerals. The deposits or residues can precipitate out of the solution (e.g., water) as it is heated to vapor. Typically, the precipitates themselves are much smaller than the opening of the outlet 24, so they are discharged with the vapor and do not build up or otherwise cause clogging. However, larger particles can be created in the form of deposited material that has been freed from the inner surface during operation and that is carried by the liquid and vapor toward the outlet 24. Also, even the smaller precipitates themselves can cause buildup right at the outlet 24 over time, causing partial or complete blockage and degraded operation of the steam generator 20.

The array of members 44 provide the above-discussed filtering with increased surface area by virtue of extending across a relatively wide area adjacent to the outlet 24 and creating a large number of paths through which the vapor can travel toward the outlet 24. Any small number of spaces between members 44 may become clogged without substantially reducing the ability of the vapor to travel to the outlet 24. The vapor will naturally be directed around such clogs toward open spaces and paths through the members 44 to the outlet 24. It is only when most of these spaces become clogged that performance will degrade significantly, and this clogging occurs over a much longer period of time than the time required to clog the outlet 24 if no filtering were provided. Thus, the usable lifetime of the steam generator 20 can be significantly increased over other steam generators not employing such filtering.

As shown in FIG. 5, the members 44 may be spaced apart by different spacings S1, S2 and S3. In one embodiment, the spacings S1, S2, S3 between the members 44 can be in the range of from about 1 mm to about 10 mm. In some embodiments, the spacing S1, S2, S3 between the members 44 can be in the range of about 1.5 mm, or about 2 mm, or about 2.5 mm, or about 3 mm, or about 3.5 mm, or about 4 mm, or about 4.5 mm, or about 5 mm, or about 6 mm, or about 7 mm, or about 8 mm, or about 9 mm. In other embodiments, the spacing S1, S2, S3 between the members 44 can be less than about 10 mm, or less than about 7.5 mm, or less than about 5 mm, or less than about 2.5 mm.

In some examples, the spacing S1, S2, S3 between the members 44 can be the same (e.g., S1=S2=S3=2 mm). In other examples, the spacing S1, S2, S3 between the members 44 can be different (e.g., S1=1 mm, S2=2 mm, S3=3 mm). Alternatively, the spacing S1, S3, S3 between the members 44 can be a combination thereof.

In one embodiment, the spacing S1, S2, S3 between the members 44 may be smaller than the diameter of the outlet 24. In operation, when the mineral deposits or precipitates are larger than the opening of the outlet 24, they may be trapped between the members 44. In the alternative, when the mineral deposits or precipitates are smaller than the orifice of the outlet 24, they are more likely to pass through the members 44 and be discharged through the outlet 24.

In some embodiments, the members 44 can take on a patterned grid formation or have an organized orientation or alignment. In other embodiments, the members 44 can be randomly distributed in the top 40 without any orientation or alignment. Alternatively, the members 44 can have a combination of configuration, orientation and alignment.

Although in the illustrated embodiment the members 44 are formed integrally with the top 40, in alternative embodiments similar members 44 or other components of a filter structure 16 may be part of a separate filter element that is inserted into the flow path.

Figure 6:
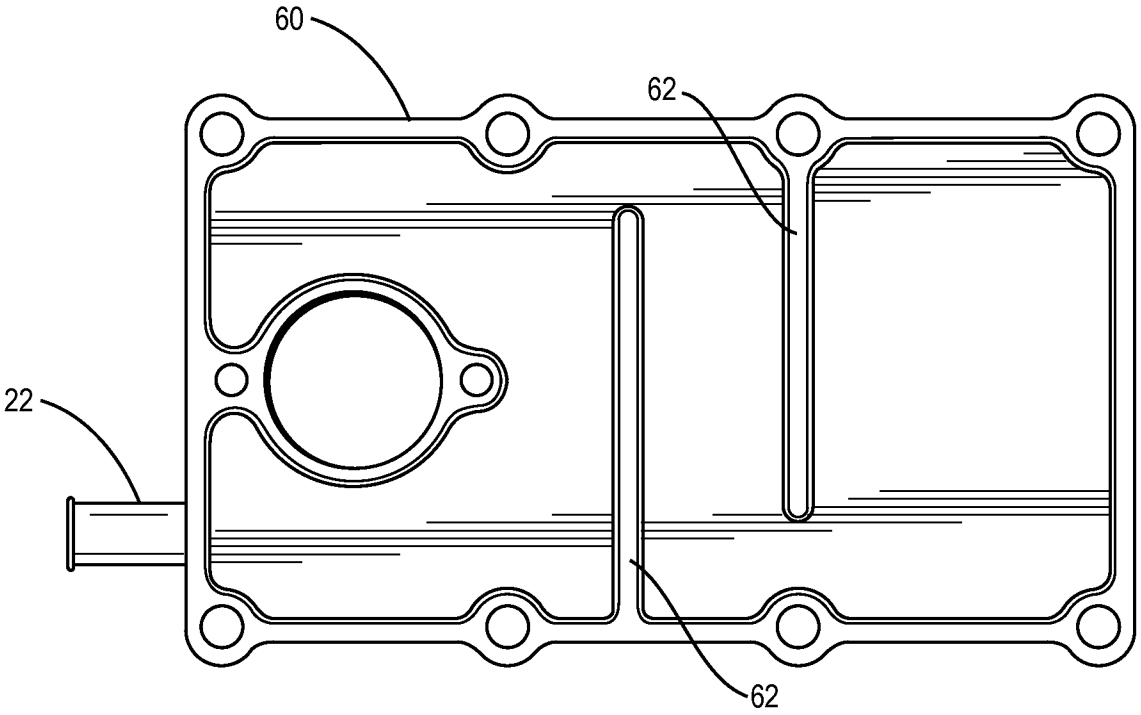
FIG. 6 is a view of an inner surface of a bottom of the steam generator.

FIG. 6 is a view of an inner surface of the bottom section 60 of the steam generator 20. Similar to the top 40, the bottom section 60 includes a pair of vanes 62 for guiding the fluid and vaporized mediums. In some embodiments, the vanes 62 may create a vortex motion within the cavities or chambers of the steam generator 20. The cyclonic or vortex motion within the cavities can force precipitates or particles out of the flow path. In the alternative, the vortex motion may cause fast moving flow path during the conversion of fluid medium to vaporized medium and create better cleaning action of the vaporized medium within the steam generator 20. In other words, fast moving steam may act as a cleaner and minimize the accumulation of mineral deposit particles. Any mineral deposit particles can be broken or disrupted by the fast steam motion and discharged through the outlet 24.

Figure 7:
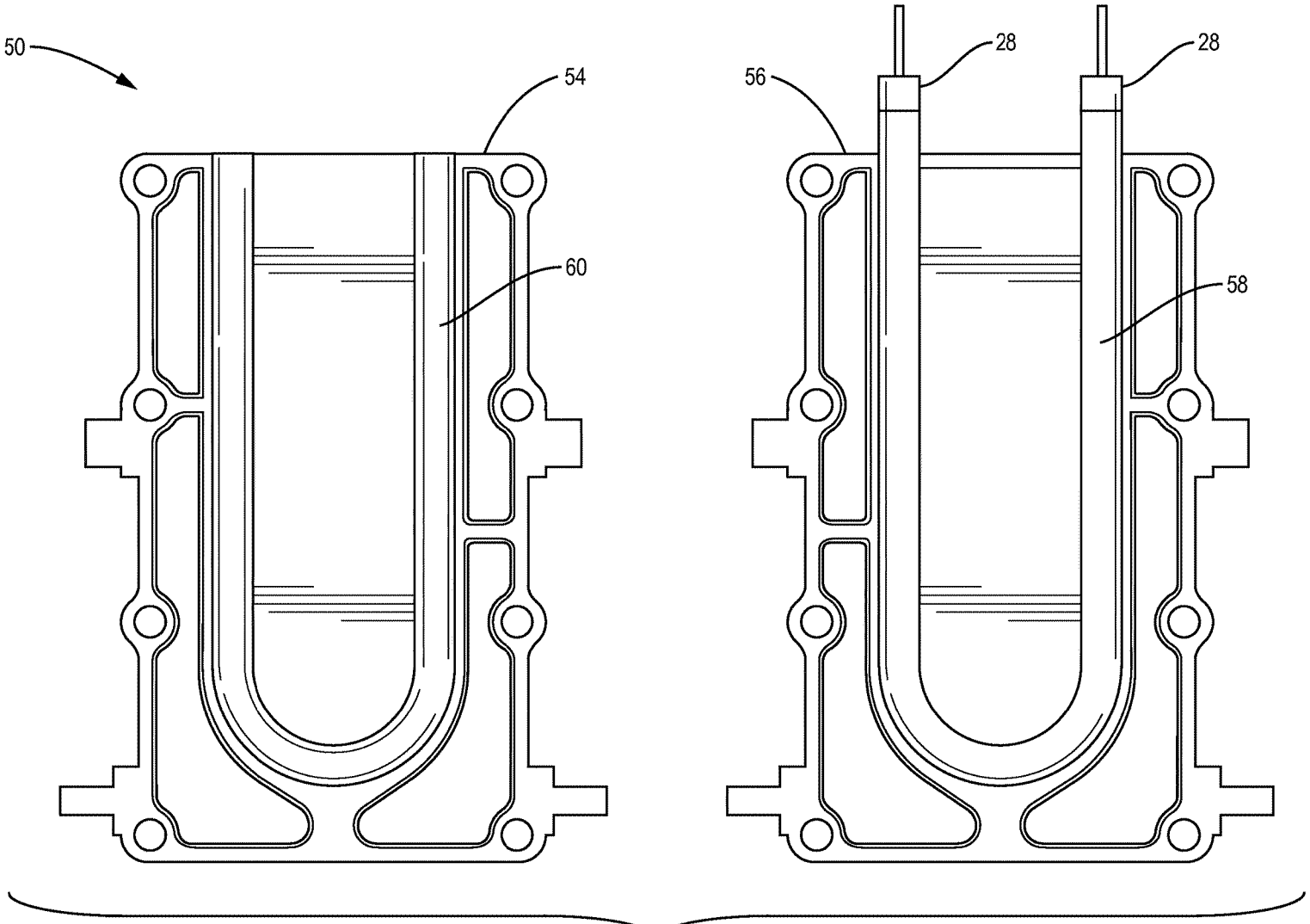
FIG. 7 is a view of a center section of the steam generator.

FIG. 7 is a deconstructed view of the center section 50 of the steam generator 20, which has a shell-like construction employing top and bottom members 54, 56. It includes a U-shaped heating element 58 of substantially circular cross section throughout, housed within corresponding U-shaped recesses 60 of the members 54, 56. In the illustrated embodiment, the heating element 58 has a diameter of about 6 mm and receives electrical power via the contacts 28. In one embodiment, the heating element 58 is capable of delivering 1200 W of power, or 1300 W of power, or higher. In some embodiments, the heating element 58 can produce other power output levels. In some embodiments, the heating element 58 can take on other shapes and sizes.

In the above description of the steam generator 20, the inlet 22 is shown in the bottom 60, while the outlet 24 is shown in the top 40 and the heating element 52 in the center section 50. These items may be positioned differently in different embodiments. In many cases it will be desirable that the heating element be centermost to minimize undesirable heating of exterior surfaces of an appliance that contains the steam generator 20. In addition, although the steam generator 20 as shown includes three sections 40, 50, 60, it will be appreciated that alternative arrangements may employ more or fewer sections, or use of a single integrally formed unit.

In some embodiments, a steam generator as disclosed herein need not be pressurized. In other embodiments, the steam generator 20 disclosed herein may be pressured. In some instances, the steam generator 20 can be oriented in a vertical orientation in operation (i.e., inlet and outlet spaced apart in mostly a vertical direction), while in other instances, the steam generator 20 can be oriented in a horizontal orientation. Alternatively, the steam generator 20 can be oriented at multi-variable angles or in multi-variable directions/orientations when mounted within the steam appliance.

A steam generator as disclosed herein may have a relatively small footprint (e.g., smaller in size, weight) and be incorporated in a handheld steam apparatus such as a portable handheld steamer, among others, as described above. For example, the steam generator 20 can have a weight of not greater than about 500 grams, or not greater than about 400 grams, or not greater than about 300 grams, or not greater than about 200 grams, or not greater than about 100 grams.

A steam generator as disclosed herein can deliver a life expectancy of greater than 100 hours, or greater than 150 hours, or greater than 200 hours, or greater than 250 hours, or greater than 300 hours. In doing so, the steam generators 20 can pass greater than about 100 L of water, or greater than about 200 L of water, or greater than about 300 L of water, or greater than about 400 L of water, or greater than about 500 L of water through its inlet.

While in the above description the filter structure 16 is realized by the array of members 44, in alternative embodiments it may be realized in other ways. As an example, a sufficiently fine-grained metal mesh may be employed. A metal mesh or similar structure may advantageously provide a large surface area, extending the usable life of the steam appliance accordingly.

While various embodiments of the invention have been particularly shown and described, it will be understood by those skilled in the art that various changes in form and details may be made therein without departing from the scope of the invention as defined by the appended claims.

What is claimed is:

1. A steam generator for a small appliance, comprising:

an inlet configured to receive a liquid;

a heating element for converting the liquid into a vapor, the vapor bearing particles formed by the converting of the liquid;

an outlet in fluid communication with the inlet, the outlet configured to discharge filtered vapor and having a size on the order of larger ones of the particles;

a filter structure to filter the larger particles out of the vapor to produce the filtered vapor for discharge from the outlet, wherein the filter structure comprises an array of spaced pillars forming a screen that is larger than an opening of the outlet;

a planar passage at the outlet;

a planar outer cover comprising a planar top section and a planar bottom section, wherein the outlet is located in the planar top section and the inlet is located in the planar bottom section; and a planar interior section disposed between the planar top section and the planar bottom section of the planar outer cover and containing the heating element;

wherein interior planar surfaces of the planar outer cover and the planar interior section define at least part of a fluid flow path including the planar passage;

wherein the interior planar surfaces of the planar outer cover and the planar interior section include vanes configured to guide the fluid along the fluid flow path; and wherein the spaced pillars extend between the interior planar surfaces of the planar outer cover in an orientation orthogonal to the planar surface of the planar outer cover and the planar surface of the planar interior section.

2. The steam generator according to claim 1, wherein spacing among the spaced pillars includes at least some spacing smaller than the opening of the outlet.

3. The steam generator according to claim 1, wherein spacing among the spaced pillars is in a range of 1 to 10 millimeters.

4. The steam generator according to claim 1, wherein the pillars have a polygonal cross section.

5. The steam generator according to claim 4, wherein the polygonal cross section is a square cross section.

6. The steam generator according to claim 1, wherein the vanes define points at which a direction of the fluid flow path changes abruptly.

7. The steam generator according to claim 1, wherein a second cover includes the inlet and defines, along with the planar interior section, another part of the fluid flow path.

8. The steam generator according to claim 1, wherein the planar outer cover includes the pillars formed integrally therewith.

9. The steam generator according to claim 1, wherein the planar passage includes a non-integral filter element as part of the filter structure.

10. The steam generator according to claim 1, further including a thermostat located adjacent to the inlet to sense an operating temperature of the steam generator.

11. The steam generator according to claim 1, wherein the particles are salts of minerals occurring in cation form in the liquid.

12. The steam generator according to claim 11, wherein the minerals include calcium and magnesium.

* * * * *